United States Patent [19]

Rometsch et al.

[11] 4,077,745

[45] Mar. 7, 1978

[54] ADJUSTMENT MECHANISM FOR RADIAL-PISTON PUMP

[75] Inventors: Werner Rometsch, Gerlingen; Horst Willmer, Hemmingen, both of Germany

[73] Assignee: Robert Bosch GmbH, Stuttgart, Germany

[21] Appl. No.: 767,356

[22] Filed: Feb. 10, 1977

[30] Foreign Application Priority Data

Feb. 26, 1976 Germany ..... 2607780

[51] Int. Cl.[2] ..... F04B 1/06

[52] U.S. Cl. ..... 417/221; 60/445

[58] Field of Search ..... 417/217-222; 60/445, 447, 450, 452

[56] References Cited

U.S. PATENT DOCUMENTS

| | | | |
|---|---|---|---|
| 2,502,546 | 4/1950 | Adams | 417/222 X |
| 3,431,857 | 3/1969 | Jennings et al. | 417/218 |
| 3,489,094 | 1/1970 | Vaughan et al. | 417/222 X |

FOREIGN PATENT DOCUMENTS

| | | | |
|---|---|---|---|
| 2,419,460 | 11/1975 | Germany | 417/218 |
| 2,424,149 | 4/1976 | Germany | 417/221 |
| 1,157,080 | 11/1963 | Germany | 417/218 |

*Primary Examiner*—William L. Freeh
*Assistant Examiner*—Edward Look
*Attorney, Agent, or Firm*—Michael J. Striker

[57] ABSTRACT

A pump has a rotatable rotor carrying a plurality of radially-extending pistons bearing at their outer ends on an annular adjustment ring which can be displaced radially in the pump housing by means of a pair of diametrically opposed adjustment cylinders that serve to displace this ring and adjust the stroke of the radial pistons in the rotor. One of the adjustment pistons is of larger diameter than the other and both of the adjustment pistons are spring-biased against the outer periphery of the adjustment ring and both have throughgoing bores so that pressure behind these adjustment pistons is fed to pressure-relief pockets at their inner ends against the adjustment ring. The small-diameter piston is provided in its through-going passage with a pressure-limiting valve which only allows pressure past to its respective pressure-relief pocket when pressure behind the smaller piston exceeds a predetermined minimum which is approximately a tenth of the maximum pump operating pressure. Thus during starting-up of the pump the pressure-relief pocket at the small piston is not pressurized to increase friction between the inner end of this piston and the adjustment ring so as to inhibit rotation of the adjustment ring around the rotor.

11 Claims, 2 Drawing Figures

ADJUSTMENT MECHANISM FOR RADIAL-PISTON PUMP

BACKGROUND OF THE INVENTION

The present invention relates to a pump. More particularly this invention concerns an adjustment arrangement for a pump wherein the rotor carries a plurality of radially movable displacement elements whose strokes can be adjusted by a ring surrounding the rotor which is in turn radially positioned by a pair of diametrically opposite pistons.

A radial-piston pump is known whose rotor is surrounded by an adjustment ring against one radial side of which bears a relatively large-diameter piston and against its other side bears a relatively small-diameter piston. The pump output, that is fluid pressurized by the radially-displaceable pistons in the rotor, is fed directly to the small-diameter piston which bears on its radially inner end against the adjustment ring.

In such an arrangement it is customary to form a passage extending radially of the rotor through the small-diameter piston and terminating at the inner end of this small piston at a so-called pressure-relief or depressurizing formation. Such a formation serves to reduce the surface contact between the adjustment ring and the small piston as well as to reduce the force necessary for adjustment of this ring. Nonetheless such a depressurizing has the effect that in the central position of the ring, that is when it is coaxial with the rotor, and when the output pressure of the pump is very low, the friction between the adjustment ring and the small piston is also very low. Thus, the rotor frequently rotationally entrains the adjustment ring due to the friction between the various pumping pistons in the rotor and this ring so that very quickly the ring is brought up to the same rotational speed as the rotor. Such entrainment of the adjustment ring has a gyro effect so that much more force is needed than normally to radially displace it.

SUMMARY OF THE INVENTION

It is therefore an object of the present invention to provide an improved pump.

Another object of this invention is to provide an improvement for a pump of the above-described general type so as to overcome the above-given disadvantages.

Another object is to provide a pump wherein the initial displacement of the adjustment member out of the central position coaxial with the rotor is relatively easy even at high rotation speeds of the pump.

These objects are attained according to the invention by providing in the passage through the small piston a pressure-limiting valve effective to only allow fluid through this small piston to the pressure-relief formation when the pressure behind the piston is greater than a small fraction of the maximum output pressure of the pump, preferably one-tenth thereof.

With the system according to the present invention the small piston will therefore be first pressed against the adjustment ring of the pump as the pump is started up without the fluid behind this small piston feeding through it to the pressure-relief area. Only when the adjustment pressure reaches a predetermined level, generally between 20 and 30 bars according to this invention, does the pressure-limiting valve open so that the pressure behind the small piston no longer raises and the hydrostatic pressure relief between the small piston and the ring is effective.

According to further features of this invention the pump is provided with passages or conduits that serve to feed the pump output to both of the adjustment pistons. A valve is provided in the line to the large-diameter piston so as to cut this piston, if desired, off from the fluid supply, or even to connect the chamber formed behind this piston with the reservoir of the system. This large piston is formed with a radially throughgoing passage so that it also has a pressure-relief formation or pocket at the location where it bears against the adjustment ring.

The novel features which are considered as characteristic for the invention are set forth in particular in the appended claims. The invention itself, however, both as to its construction and its method of operation, together with additional objects and advantages thereof, will be best understood from the following description of a specific embodiment when read in connection with the accompanying drawing.

SPECIFIC DESCRIPTION OF A PREFERRED EMBODIMENT

Figure 1:
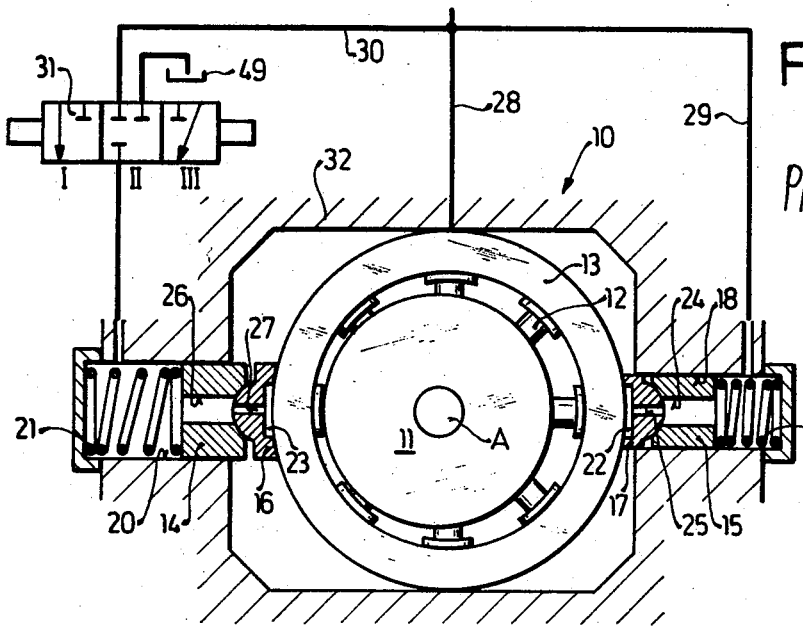
Fig. 1 PRIOR ART
FIG. 1 is a sectional and partially diagrammatic view of a prior-art pump.

As shown in FIG. 1 a standard radial-piston pump 10 has a housing 32 in which a rotor 11 carrying eight radially equispaced and radially movable pistons 12 is rotatable about an axis A. Surrounding this rotor is a circular adjustment ring 13 against whose inner periphery ride the displacement elements constituted by the pistons 12.

To one side of the ring 13 the housing 32 is formed with a bore 20 in which is slidable a large-diameter piston 14 and to the other side the housing 32 is formed with a bore 18 in which is radially displaceable a small-diameter piston 15. These pistons 14 and 15 bear by means of respective shoes 16 and 17 on the outer periphery of the ring 13. In addition respective compression springs 21 and 19 of like spring force bias the pistons 14 and 15 radially inwardly against the ring 13.

The piston 14 is formed with a bore 26 that extends radially of the axis A and longitudinally of the piston 14 and which terminates at the outer end of a much smaller radial bore 27 formed through the shoe 16 and opening at its inner end at a pressure relief region or pocket 23. Similarly, the piston 15 is formed with a large-diameter bore 24 leading to a small-diameter bore 25 in the shoe 17 that in turn terminates at a pressure-relief pocket 22.

The pump output can be fed via a line 28 and a line 29 to the chamber formed in the bore 18 behind, that is radially outside, the piston 15. The pressure can also be fed via this line 28 and another line 30 to the chamber formed in the bore 20 behind the piston 14. A valve 31 of the three-port 3-position type can be moved from the central position II shown in which flow through the line 30 to the piston 14 is interrupted to a position I wherein such flow is possible and a position III wherein the chamber behind the piston 14 is connected to a reservoir 49.

Figure 2:
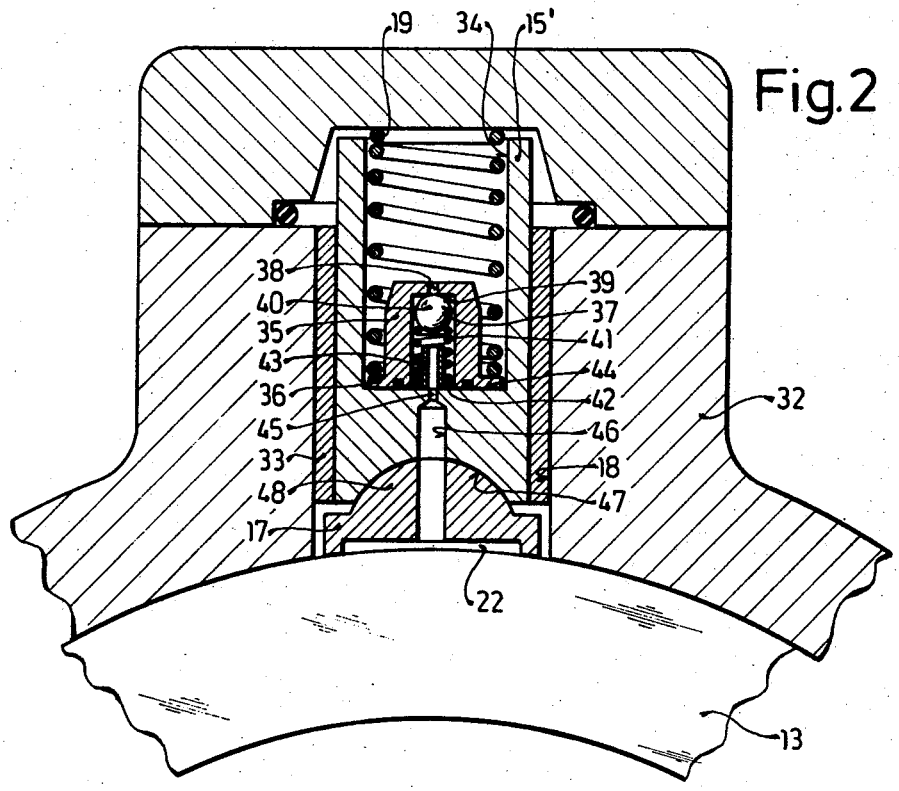
FIG. 2 is a large-scale sectional view of the improvement according to the present invention.

In accordance with the present invention as shown in FIG. 2 the simple piston 15 is replaced with a piston 15' which rides in the bore 18 within a lining sleeve 33 therein. This piston 15' is formed at its side turned away from the ring 23 with a cylindrical recess 34 in which the spring engages and in the bottom of which is provided a pressure limiting valve element 35 formed as a cup having a flange 36 lying against the bottom 44 of the recess 34 and pressed thereagainst by the spring 19. The cup 35 has a large-diameter bore 37 formed at its base 39 with a small diameter throughgoing hole 38. This base 39 constitutes the seat for a valve body 40 here formed as a ball urged by means of a spring 41 against the seat 39 at the hole 38. The other end of the spring 41 bears against an edge 42 of a support tube 43 extending radially up in line with the aperture 38 and preventing the ball 40 from moving too far away from the seat 39.

The piston 15' is further formed with a very small bore 45 at the alignment tube 42 so as to constitute a fluid-flow restriction, and is formed below this small-diameter bore 45 with a larger-diameter bore 46. Thus the bores 45 and 46 take the place of the bore 24 shown in FIG. 1. The piston 15' is also formed with a part-spherical seat 47 against which the part-spherical head 48 of the shoe 17 rides.

When the rotor 11 is driven the pump forces fluid under pressure into the line 28 so that it passes through the line 29 into the chamber formed by the bore 18 behind the piston 15'. The valve 31 meanwhile is in position II so that the chamber 20 behind the piston 14 is shut off, that is the pressure in the chamber 20 is less than in the chamber 18 due to the larger effective surface area of the piston 14. As the machine is started up the adjustment ring 13 is positioned centered on the axis A due to the identical spring pressures of the springs 19 and 21 and the different pressures of pistons 18 and 20. The hydrostatic pressure-relief pump 23 of the shoe 16 is subject to the small pressure in the chamber 20 whereas the pressure in the hydrostatic pressure-relief pocket 22 is the same as the pressure output of the pump in the prior-art arrangement.

As the prior-art arrangement is started up the pump output pressure is low so that the force with which the piston 15 bears against the ring 13 is relatively small, so that the friction between these two elements is also relatively small. Thus, in the prior art arrangement the friction between the pistons 12 and the inner periphery of ring 13 will be substantially greater than the friction between the shoes 16 and 17 and the outer periphery of this ring 13. The rotor 11 will therefore entrain the ring 13 until it rotates at substantially the same speed as the rotor 11. When rotating at this speed it is necessary to exert considerable radial pressure on the ring 13 to displace it radially relative to the axis A.

With the system according to the present invention as shown in FIG. 2 the bore 18 is pressurized behind the piston 15 with sufficient pressure to press the shoe 17 rather tightly against the ring 13 without flow of fluid into the pressure-relief pocket 22. Thus, friction between the shoe 17 and ring 13 is relatively great so that rotational entrainment of the ring 13 by the rotor 11 is not likely to occur. Only when the pressure in line 28 reaches a predetermined limit, here substantially 25 bars, is the element 40 pushed away from its seat 39 so that fluid under pressure can flow through the tube 42, the small bore 45, and the large bore 46 to the pressure-relief pocket 22. This hydrostatically balances the piston unit, but only when sufficient pressure has been built up in the system so that the ring 13 can readily be radially moved by the pistons 14 and 15'.

Thus with the system according to the present invention rotational entrainment of the adjustment ring as the pump is started up is largely ruled out. Only when the pump pressure has reached a predetermined minimum, here 25 bars, is at least the pressure-relief region 22 hydrostatically pressurized. Thus the system is much more sensitive and self-regulating than the prior-art arrangement shown in FIG. 1.

It will be understood that each of the elements described above, or two or more together, may also find a useful application in other types of construction differing from the types described above.

While the invention has been illustrated and described as embodied in a radial-piston pump, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a pump whose displacement elements have strokes variable by an annular adjustment member displaceable in turn by a pair of diametrically opposed pistons of different effective hydraulic surface areas, the pump output being supplied to the smaller piston and through a passage in said smaller piston to a depressurizing region at the interface between said smaller piston and said adjustment member, the improvement comprising means including a pressure-limiting valve in said passage for only allowing fluid flow through said passage to said depressurizing region after pressure has built up behind said piston to a predetermined level equal at most to a small fraction of the maximum pressure producible by said pump.

2. The improvement defined in claim 1 wherein said fraction is one-tenth.

3. The improvement defined in claim 2 wherein said piston includes a shoe riding on said member and forming therewith said region.

4. The improvement defined in claim 2 wherein said valve includes a seat in said passage, a valve body sealingly engageable against said seat in a direction away from said member, and a spring biasing said body against said seat.

5. The improvement defined in claim 2 wherein said pump has a housing formed with a radial bore and provided with a lining sleeve, said piston being radially reciprocal in said sleeve.

6. The improvement defined in claim 1 wherein said predetermined level is between 20 bars and 30 bars.

7. The improvement defined in claim 6 wherein said predetermined level is substantially 25 bars.

8. A pump comprising:

a housing;

a rotor rotatable in said housing about an axis;

at least one displacement element radially displaceable in said rotor to pressurize a fluid;

an adjustment ring surrounding said rotor in said housing and at least limitedly rotatable in said housing about said axis, said ring being radially displaceable in said housing to vary the stroke of said element;

a large-diameter piston radially displaceable in said housing and bearing on said ring;

a small-diameter piston radially displaceable in said housing and bearing on said ring at a location substantially diametrically opposite said large-diameter piston, said small-diameter piston being formed at its radially inner end engaging said ring with a pressure-relief formation and with a radially throughgoing passage opening at said formation, whereby said pistons can radially displace said ring to vary the stroke of said element;

means for feeding said fluid from said displacement element to the end of said small piston turned away from said ring for pressing said small piston against said ring radially; and a pressure-limiting valve in said passage preventing fluid flow through said passage toward said formation until the pressure behind said small piston is at most equal to a small fraction of the maximum pressure producible by said pump.

9. The pump defined in claim 8 wherein said element is a pump piston radially displaceable in said rotor and having an outer end riding on the inner periphery of said ring.

10. The pump defined in claim 8 wherein said valve opens and permits fluid flow through said passage when said pressure behind said small piston is generally 25 bars.

11. The pump defined in claim 8, further comprising a spring biasing each of said pistons radially against said ring and means for feeding said fluid from said element to said large piston for pressing same against said ring.

* * * * *